US005586036A

United States Patent [19]

Pintsov

[11] Patent Number: 5,586,036

[45] Date of Patent: Dec. 17, 1996

[54] POSTAGE PAYMENT SYSTEM WITH SECURITY FOR SENSITIVE MAILER DATA AND ENHANCED CARRIER DATA FUNCTIONALITY

[75] Inventor: Leon A. Pintsov, West Hartford, Conn.

[73] Assignee: Pitney Bowes Inc., Stamford, Conn.

[21] Appl. No.: 270,555

[22] Filed: Jul. 5, 1994

[51] Int. Cl.[6] ..... G07B 17/04

[52] U.S. Cl. ..... 364/464.02; 380/51; 380/55

[58] Field of Search ..... 364/464.02, 464.03, 364/466; 380/51, 55

[56] References Cited

U.S. PATENT DOCUMENTS

| | | | |
|---|---|---|---|
| 3,978,457 | 8/1976 | Check, Jr. et al. . | |
| 4,168,533 | 9/1979 | Schwartz | 364/464.02 |
| 4,301,507 | 11/1981 | Soderberg et al. . | |
| 4,493,252 | 1/1985 | Clark . | |
| 4,579,054 | 4/1986 | Buan et al. . | |
| 4,725,718 | 2/1988 | Sansone et al. . | |
| 4,743,747 | 5/1988 | Fougere et al. . | |
| 4,757,537 | 7/1988 | Edelmann et al. . | |
| 4,775,246 | 10/1988 | Edelmann et al. . | |
| 4,796,193 | 1/1989 | Pitchenik . | |
| 4,813,912 | 3/1989 | Chickneas et al. | 364/464.02 |
| 4,831,555 | 5/1989 | Sansone et al. . | |
| 4,853,961 | 8/1989 | Pastor . | |
| 4,873,645 | 10/1989 | Hunter et al. . | |
| 4,888,803 | 12/1989 | Pastor | 380/51 |
| 4,934,846 | 6/1990 | Gilham . | |
| 5,073,935 | 12/1991 | Pastor . | |
| 5,142,577 | 8/1992 | Pastor . | |
| 5,142,579 | 8/1992 | Anderson . | |
| 5,170,044 | 12/1992 | Pastor . | |
| 5,293,319 | 3/1994 | DeSha et al. . | |
| 5,375,172 | 12/1994 | Chrosny | 380/51 |
| 5,390,251 | 2/1995 | Pastor et al. | 380/21 |
| 5,410,598 | 4/1995 | Shear | 380/4 |

FOREIGN PATENT DOCUMENTS

| | | |
|---|---|---|
| 1301336 | 5/1992 | Canada . |
| 0331352 | 9/1989 | European Pat. Off. . |

*Primary Examiner*—Edward R. Cosimano
*Attorney, Agent, or Firm*—Charles R. Malandra, Jr.; David E. Pitchenik; Melvin J. Scolnick

[57] ABSTRACT

A method and system for processing mail including imprinting on a mailpiece mailer identification information. Data is encrypted relative to the mailpiece with a private key associated with the mailer identification information. The private key also has an associated public key. The encrypted data is imprinted on the mailpiece and the mailpiece is placed in a mail delivery stream of a mail carrier. The mail is thereafter processed to determine from the mailer identification information the public key. The encrypted data is decrypted with the public key to authenticate the mailer and the mailers billing records are updated for mailer charges associated with the mailpiece. The addressee information for the mailpiece may be included as part of the encrypted data for mailpiece authentication. The billing record of the mailer may be encrypted with the mailer public key and transmitted to the mailer. The various mailpieces of the mailer deposited with the carrier service may be consolidated into a single encrypted statement and provided to the mailer, either in physical form or electronically along with other information including address hygiene, availability of special services from the carrier and the like. Authentication and receipt of the mailpiece are provided using an encrypted data on the mailpiece which may include an encryption of the hash function of data associated with the mailpiece being delivered or of the content of the mailpiece being delivered. The hash code may be generated by the mailer, carrier or the recipient.

21 Claims, 6 Drawing Sheets

POSTAGE PAYMENT SYSTEM WITH SECURITY FOR SENSITIVE MAILER DATA AND ENHANCED CARRIER DATA FUNCTIONALITY

FIELD OF THE INVENTION

The present invention relates to postage payment systems and, more particularly, to a payment system for delivery of mail and parcels where the charges for the delivery and/or any special services are invoiced to the mailer by a carrier such as a postal service or private delivery service.

BACKGROUND OF THE INVENTION

Postage payment systems have been developed employing postage meters, which are mass produced devices for printing a defined unit value for governmental (such as tax stamps, or postage stamp) or private carrier delivery of parcels and envelopes. These postage meter systems involve both pre-payment of postal charges by the mailer (prior to postage value imprinting) and post payment of postal charges by the mailer (subsequent to postage value imprinting). Postal charges (or other terms referring to postal) as used herein should be understood to mean charges for either postal charges, tax charges, or private carrier charges or the like (or postal service, tax service or private carrier service, as the case may be).

Some of the varied types of postage metering systems are shown, for example, in U.S. Pat. No. 3,978,457 for MICROCOMPUTERIZED ELECTRONIC POSTAGE METER SYSTEM, issued Aug. 31, 1976; U.S. Pat. No. 4,301,507 for ELECTRONIC POSTAGE METER HAVING PLURAL COMPUTING SYSTEMS, issued Nov. 17, 1981; and U.S. Pat. No. 4,579,054 for STAND ALONG ELECTRONIC MAILING MACHINE, issued Apr. 1, 1986. Moreover, other types of metering systems have been developed which involve different printing systems such as those employing thermal printers, ink jet printers, mechanical printers and other types of printing technologies. Examples of these other types of electronic postage meters are described in U.S. Pat. No. 4,168,533 for MICROCOMPUTER MINIATURE POSTAGE METER, issued Sep. 18, 1979 and, U.S. Pat. No. 4,493,252 for POSTAGE PRINTING APPARATUS HAVING A MOVABLE PRINT HEAD AND A PRINT DRUM, issued Jan. 15, 1985. These systems enable the postage meter to print variable information, which may be alphanumeric and graphic type information.

Postage metering systems have also been developed which employ encrypted information on a mailpiece. The postage value for a mailpiece may be encrypted together with other data to generate a digital token. A digital token is encrypted information that authenticates the information imprinted on a mailpiece such as postage value. Examples of postage metering systems which generate and employ digital tokens are described in U.S. Pat. No. 4,757,537 for SYSTEM FOR DETECTING UNACCOUNTED FOR PRINTING IN A VALUE PRINTING SYSTEM, issued Jul. 12, 1988; U.S. Pat. No. 4,831,555 for SECURE POSTAGE APPLYING SYSTEM, issued May 15, 1989; U.S. Pat. No. 4,775,246 for SYSTEM FOR DETECTING UNACCOUNTED FOR PRINTING IN A VALUE PRINTING SYSTEM, issued Oct. 4, 1988; U.S. Pat. No. 4,873,645 for SECURE POSTAGE DISPENSING SYSTEM, issued Oct. 10, 1989 and, U.S. Pat. No. 4,725,718 for POSTAGE AND MAILING INFORMATION APPLYING SYSTEMS, issued Feb. 16, 1988. These systems, which may utilize a device termed a Postage Evidencing Device (PED), employ an encryption algorithm which is utilized to encrypt selected information to generate the digital token. The encryption of the information provides security to prevent altering of the printed information in a manner such that any change in a postal revenue block is detectable by appropriate verification procedures.

Encryption systems have also been proposed where accounting for postage payment occurs at a time subsequent to the printing of postage. Systems of this type are disclosed in U.S. Pat. No. 4,796,193 for POSTAGE PAYMENT SYSTEM FOR ACCOUNTING FOR POSTAGE PAYMENT OCCURS AT A TIME SUBSEQUENT TO THE PRINTING OF THE POSTAGE AND EMPLOYING A VISUAL MARKING IMPRINTED ON THE MAILPIECE TO SHOW THAT ACCOUNTING HAS OCCURRED, issued Jan. 3, 1989; U.S. Pat. No. 5,293,319 for POSTAGE METERING SYSTEM, issued Mar. 8, 1994; and, U.S. Pat. No. 5,375,172, for POSTAGE PAYMENT SYSTEM EMPLOYING ENCRYPTION TECHNIQUES AND ACCOUNTING FOR POSTAGE PAYMENT AT A TIME SUBSEQUENT TO THE PRINTING OF POSTAGE, issued Dec. 20, 1994, or its Canadian counterpart patent No. 1 301 336.

SUMMARY OF THE INVENTION

It has been discovered that a public key cryptographic system can be employed in postage payment systems to greatly enhance the features and functionality of the system. This provides the ability of a carrier to securely and accurately invoice a mailer for mail placed into a postage system.

It has also been discovered that by the employment of a public key cryptographic system that a postage payment system can be provided where the payment is based on an invoice provided by the carrier which provides enhanced billing or marketing or demographic or other information, securely to the mailer utilizing the mailer billing information.

It has been further discovered that various unique services to authenticate and verify the delivery, receipt or even receipt for the specific content of the mailpieces and parcels can be achieved.

It has still further been discovered that by utilizing the system, address hygiene information can be securely transmitted to the mailer by the carrier such that this information can be a value added service along with other services provided by the carrier.

In accordance with the present invention a method for mail processing includes imprinting on a mailpiece mailer identification information. Data relative to the mailpiece is encrypted with a private key associated with the imprinted mailer identification information. The private key also has an associated a public key. The encrypted data is imprinted on the mailpiece. The mailpiece is placed in a mail delivery stream of a mailpiece carrier. The mail is processed to determine the mailer identification information. Using the mailer identification information the public key is obtained and used to decrypt the encrypted data to authenticate the mailer. The billing records for the mailer are updated for charges associated with the mailpiece.

A system embodying the present invention includes processing mail, printing means for imprinting information on a mailpiece and means for causing the printing means to imprint on the mailpiece mailer identification information. Means are coupled to said printing means for encrypting data relative to said mailpiece with a private key associated with the mailer identification information, the private key having an associated public key. Means cause the printing means to imprint on the mailpiece the encrypted data. Means process the mailpiece to determine the mailer identification information. A public key database is coupled to the processing means such that the determined mail identification data is utilized to retrieve the public key. Means for decrypting the encrypted data with said retrieved public key to authenticate the mailpiece mailer. Means are coupled to said decrypting means for generating a billing record for said mailer for charges associated with said mailpieces.

In accordance with a feature of the invention, a method for generating an electronic receipt for a mailpieces, includes the steps of receiving a mailpiece and determining from the mailpiece mailer identification data and mailpiece identification data. The mailer identification data and the mailpiece identification data and recipient identification data are encrypted with a recipient private key, recipient private key having an associated public key. The encrypted data and the recipient identification data re transmitted to the mailer.

In accordance with still another feature of the present invention, method for generating an encrypted receipt to authenticate the receipt of a mailpiece, includes, generating a hash code for the information of a mailpiece and encrypting the generated hash code for the mailpiece with a first private key to generate an encrypted hash code of the mailpiece information, the private key having an associated first public key. The mailpiece along the encrypted hash code are transmitted. The mailpiece and the encrypted hash code are received by a recipient and the encrypted hash code is encrypted with a second private key, the second private key associated with said recipient said having an associated second public key.

In accordance with yet another feature of the present invention, method for processing mail includes generating a mailpiece and generating a hash code of the content of the mailpiece. The encrypted hash code is encrypted and the mail is imprinted with addressee data and the encrypted hash code.

BRIEF SUMMARY OF THE DRAWINGS

A complete understanding of the present invention may be obtained from the following detailed description of the preferred embodiment thereof, when taken in conjunction with the accompanying drawings, wherein like reference numerals designate similar elements in the various figures, and in which.

DETAILED DESCRIPTION OF THE PREFERRED EMBODIMENT

I. General Background

Figure 1:
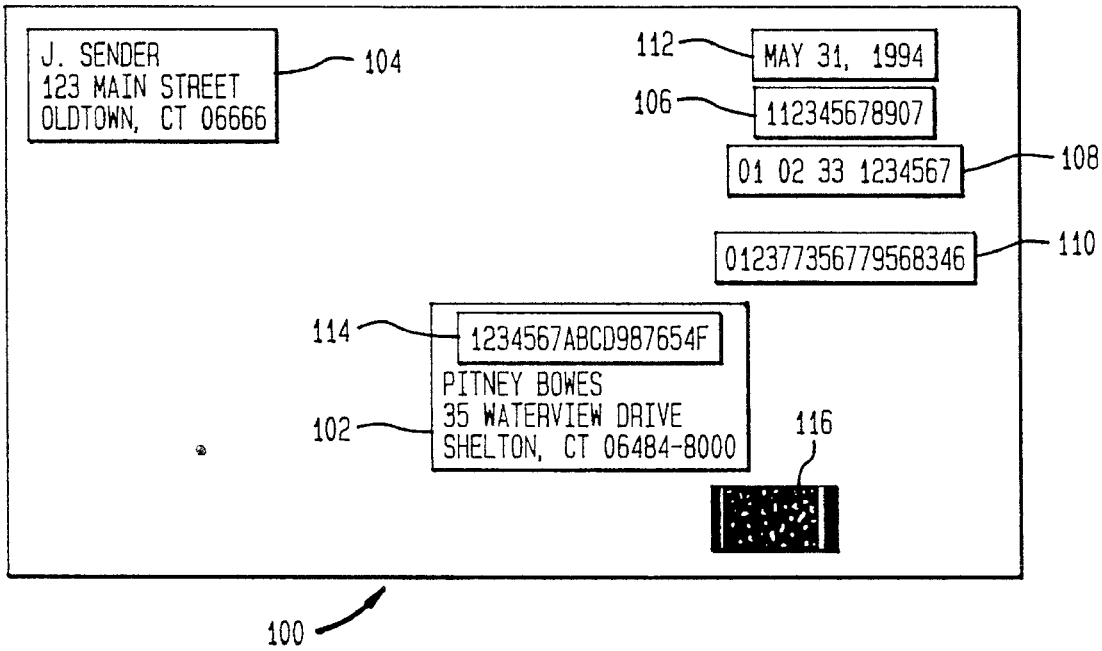
FIG. 1 is a mailpiece having encrypted information imprinted thereon in accordance with the present invention which is thereafter utilized by a carrier in generating billing information and utilized to provide additional verifications and information and services to a mailer.

A public key cryptographic system is used for identification of mailers. A carrier such as a postal service or private delivery service, or a third trusted party, generates a pair of private/public keys for each mailer. Each mailer may also obtain a certificate with his private key. The certificate is digitally singed by the post (or a third trusted party) with its private key, thus authenticating the mailer. The certificate can be in the form of a smart card or PCMCIA card, both of which can be used with a standard personal computer.

The public keys for the mailers are published in a directory that is distributed to all mail processing services for use in machines with scanning capabilities. Examples of equipment with such scanning capability are advanced postal service facer/cancelers, MULTILINE OPTICAL CHARACTER RECOGNITION SORTERS and barcode sorters. Each mailer protects his or her private key just as in any other public key cryptographic system, for example, by a password, personal identification number (PIN) or a cryptographic protocol designed for use with a personal computer or other device which functions as part of a mail generating system. Key update, revocation, initialization and other procedures are well known and described, for example, in key management standards, as for example, the X9.17 standards/published by X.9 Secretariat, American Bankers Association, 1120 Connecticut Avenue, N.W., Washington, D.C. 20036, dated Apr. 4, 1985 or ANSI/ABA X9.24-1992, dated Apr. 6, 1992.

As part of the mail generation process, first, for each mail piece to be generated, the mailer determines: the date, desired level of service, such as delivery date and special insurance, or returned receipt, etc. The mailer may also determine the postal rate for the piece and desired destination address. This information (or portion of it) together with a mailer's identification (such as a 10 digit number) is encrypted with the mailer's private key. The resulted ciphertext is printed in a machine readable format together with the mailer's identification printed in a plaintext on the surface of the mailpiece or parcel or mailing label or tag.

Upon receiving the mail piece, postal processing equipment scans the mail piece and determines mailer'identification from the plain text mentioned above. The identification serves as a pointer in the directory of public keys assigned to mailers. This allows the postal mail processing machine to quickly retrieve the public key matching the mailer's private key that is needed to decrypt the remaining information obtained by scanning the ciphertext printed on a mail piece. This decrypted information is used to generate billing data that can be used for customer's billing. In case that customer determined rate does not match postal rate, the data can be verified manually or go through a dispute or other resolution process.

An important advantage of the above arrangement is that the mailer can not repudiate his ownership of the mail piece and then the postpayment billing for the mailpiece, since only the mailer was in possession of the matching private key. The copying of the data printed on a mailpiece by a third party does not make much economic sense since the address destination information is encrypted together with mailer's identity. Thus, a copy would have to be sent to the same destination which usually not practical. Mailpieces, that do not display mailer's identification in one way or another can not be processed in this manner because the mailer's or associated public key must be identified and used in the decryption process. As an alternative to the mailer identification, the mailer's identification can, if desired, be uniquely determined from the return address.

Another important advantage of the system is that delivery confirmations can be effectively organized. The mail recipient can digitally sign by encrypting a message containing unique sender identification and unique mail piece identification with his own private key. The mail sender upon receiving the confirmation can decrypt the mail receiver signature with the mail recipient public key. This provides for non repudiation of receipt, which can be an important aspect in the case of legal disputes, as for example, the receipt of negotiable securities by a bank or other institution which will normally provide a receipt.

The billing information can be encrypted by the carrier for privacy. This protects the mailer data base and other potentially sensitive information, as for example, financial information. This can be achieved simply by encrypting all the relevant billing information such as number of pieces sent, addresses, postage paid, delivery confirmation etc. with the mailer's public key (the same that was used to decrypt mailer's authentication block on the mailpiece). Then, only the legitimate mailer who is in possession of the matching private key will be able to decrypt the billing data, reconcile it with the mailer's own records and initiate payment of the bill or other appropriate action.

The entire process can be made transparent to the mailer by prearranging appropriate communication protocols such as those used in electronic data interchange (EDI) or by printing the same information a record with a suitable density two dimensional bar code such as PDF 417 or Code 1. This arrangement allows for a proof of expenses paid which may be useful for taxation purposes.

There are multiple advantages of the present system. It offers highly flexible service of absent some unusual circumstances. Each mailpiece is uniquely identified. Thus, tracking and tracing become very effective and allows for service monitoring.

The use of a public key encryption system for post charge system for mail delivery services provides a major advantage in key management. Specifically, with a public key system, the management of the private key used by the mailer to encrypt the mailpiece identification is not as difficult and burdensome a task as in a secret key encryption system. This is because the private key used by the mailer in a public key system envisions a matching public key used by the carrier service to decrypt the encryption. Thus, the decryption of the authentication block becomes a simple matter of identifying the mailers public key, which identification can be entered onto the mailpiece itself. In sharp contrast, the use of a secret key encryption system where both the mailer and the carrier are required to have the same secret key involves a much greater burden in key management. This is because security of the key must be maintained at both the mailer and the carrier locations. Thus, for a carrier location where access to the key may be required by multiple people on different days and under different circumstances, key management, and more specifically, the security of the key management, may become a major obstacle to implementing, in a practical sense, systems of this type.

Furthermore, in the public key system as described herein, should the mailers private key used for encryption become compromised, the mailer simply need inform the carrier services which can thereafter deactivate the mailer private key for the particular account. Lockout and time changes can be instituted as a matter of routine to provide enhanced security.

The employment of a public key system should reduce billing disputes due to allegations of compromise of the secret key by the carrier with subsequent improper billing of the mailer. Since only the mailer has the private key, and only very limited number of carrier personnel associated with issuing the secret key to the mailer, and since decryption is implemented using the mailers public key, compromise of the mailer's private key which may result in billing for services not rendered or not requested, is, for all practical purposes, within the responsibility of the mailer.

An important feature of the present invention is that the post office can use billing as an effective communication channel to mailers. Together with the bill, many different services, discounted rates and other information can be passed to mailers. For example, if the post office or carrier service wishes to improve its capacity utilization in a given geographic area, it can communicate selectively to mailers in the area the availability of lower rates for mailers mailing from such a geographic area. Other examples include advertising goods and services for other business, providing mailing lists to mailers, address hygiene, etc. It should be expressly noted that the bill (together with the just mentioned advertising and promotional information) can be sent to mailers either via traditional mail or through a telecommunications channel such as a modem and public telephone network.

II. Mailer System

Reference is now made to FIG. 1. A mailpiece 100 is imprinted with data blocks 102, 104, 106, 108, 110 and 112. Block 102 is the destination address. Block 104 is the origination address, which may uniquely identify the mailer. Block 106 is the mailer's unique identification number (MID) in this case 112345678907. Block 108 represents service data required by the mailer and a unique identification for the mailpiece. Block 108, specifically 01 02 33 1234567, is formed as follows. The first two digits "01" may represent a type of mail or a mail class that would typically be indicative of required delivery time, e.g. within 3 days. The second two digits "02" may represent a rating parameters such as weight, size etc. The use of rating parameters is described in U.S. Pat. No. 5,448,642 for POSTAL RATING SYSTEM WITH VERIFIABLE INTEGRITY issued Sep. 5, 1995, the entire disclosure of which is hereby incorporated by reference. Combination of such parameters can be encoded with more than two digits if needed. For example, if there are 20 different weight categories and 6 different size classes, then the total number of possible combinations is 6×20=120. Each combination can be encoded with three digit number. The third group of two digits "33" may represent a service requirement, such as, insured letter with a confirmation of delivery. The last group of digits "1234567" is a unique mail piece identification. This may also be a consecutive non-resettable count of the mail generation system shown in FIG. 2.

Block 112 represents the date of mailing (i.e. the date when the mailpiece was deposited and under control of the carrier), in this case May 31, 1994. The date is used among other things to verify mailer's public key certificate validity, which may have an expiration date. Block 114 represents the digital signature, SIG in hexadecimal notation, of the mailpiece's content signed with mailer's private key. Finally, the group of digits "012377356779568346" labeled 110 is postal (or carrier) authentication block (PAB). This block is obtained by encrypting blocks MID, MSD and delivery address data (DAD) and Date with the mailer's private key SKm. Thus, PAB=Encryp SKm [MID, MSD, DAD, DATE].

PAB can be interpreted as a digital signature of the mailer, which provides the properties of origin authentication, data integrity and signer nonrepudiation. Additionally check digits and other redundancy can be added to the data blocks MID, MSD, DAD, DATE and PAB to facilitate effective error free scanning. It should be expressly noted that the PAB can be quite large and contain several hundreds bytes of data depending on the type of a public key cryptographic system used. In this case the PAB can be printed in a suitable two dimensional bar code such as PDF 417. Bar code representation 116 is merely a representation of the type of bar code that can be employed and can be printed at any suitable location on the envelope. Such bar code arrangement may be preferable from the scanning point of view depending on the scanning equipment employed. It should be also noted that the PAB block can be printed either on the surface of the mailing envelope, or on a label, or on the address bearing document in such a manner that the block PAB is contained within the window of the mailing envelope.

It should be understood that the mailer identification (MID) may or may not be encrypted into the block PAB. The block PAB can not be decrypted to authenticate the mailer without knowledge of the mailer's public key. This key can be found only if the mailer's identification is known. Thus, if mailer's identification is not encrypted into PAB and it is deliberately or inadvertently altered, the mailpiece cannot be authenticated. It is possible in principle to find the mailer's identification from he originating address 104, but this is more cumbersome since it usually requires a reliable automatic reading of multiple lines of alphanumeric data in the block 104 as opposed to reading of just a string of numerals.

Figure 2:
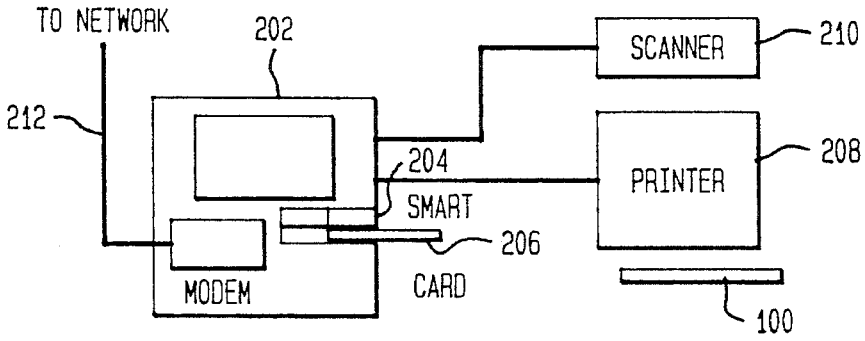
FIG. 2 is a block diagram of a mail generation system suitable for preparing the mailpiece shown in FIG. 1.

Reference is now made to FIG. 2. FIG. 2 is a block diagram of a mail generation system suitable for use with the present invention and for printing the mailpiece shown in FIG. 1. A personal computer 202 equipped with a smart card reader 204 and card 206 or other arrangement such as employing a PCMCIA or a smart diskette, and a printer 208 suitable for printing information either on a address bearing document or on a mailing envelope such as mail piece 100. The system may also include a scanner 210 and a link 212 to a public or other network. This scanner and link may be utilized to obtain data or other information to be imprinted on the mailpiece 100. The scanner would obtain the data or other information by scanning documents, and the link would obtain the data or other information via a public or private network.

Figure 3:
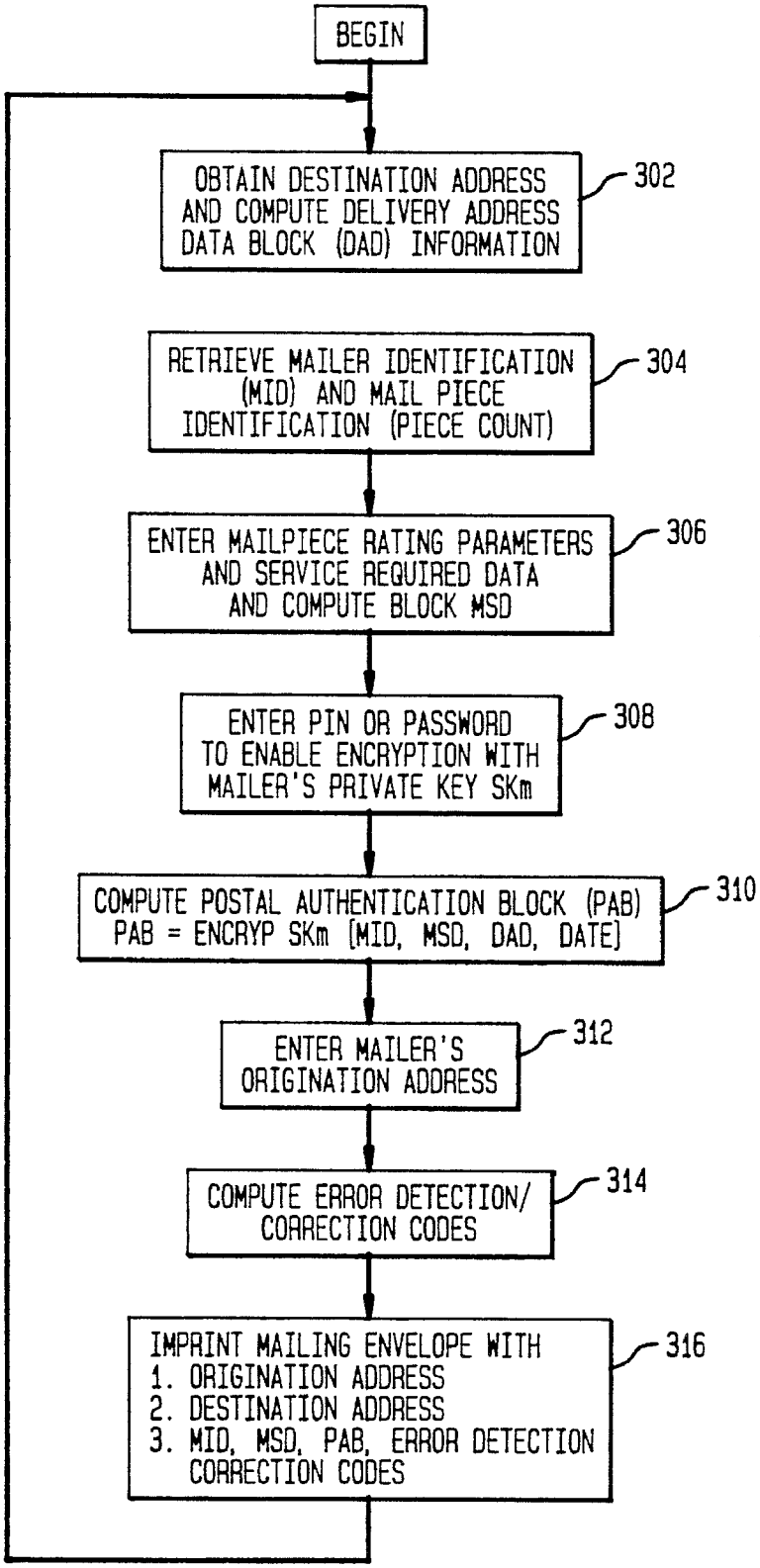
FIG. 3 is a flow chart of the operation of the system shown in FIG. 2 in generating the mailpiece shown in FIG. 1.

Reference is now made to FIG. 3. For each mailpiece, the destination address is obtained and the delivery address data block (DAD) is computed at 302. The mailer identification (MID) and mailpiece identification (Piece Count) are then retrieved at 304. At 306 the mailpiece rating parameters are entered and the service required data, that is the level of service and service features required by the mailer, are then determined to compute the mail service data block (MSD). The mailer then enters the PIN number or password to enable the encryption to proceed with the mailers private key, $SK_M$ at 308. At 310 the postal authentication block (PAB) is computed in accordance with the function that PAB equals the encryption by the mailer using the secret key $SK_M$ of the data, MID, MSD, DAD, and DATE. It should be recognized that the postal authentication block and the data encrypted is a matter of choice and convention established by the carrier.

The mailer then enters the mailers origination address at 312. It should be noted that the mailers origination address and the block 106 on mailpiece 100 shown in FIG. 1 should desirably be consistent and to provide a form of verification for the carrier as a matter of data consistency to insure that no processing errors have occurred. Moreover, such consistency also provides a level of security since both a visually readable and identifiable mailer origination address is consistent with the less easily interpreted (requiring a lookup table) mailer unique identification number.

At 314 error detection/correction codes are computed to be printed on the mailpiece to provide additional level of redundancy for automatic scanning and processing of the mail to verify the entry and printing of the consistent data by the mailer. It also provides by virtue of the redundancy consistent automatic reading of information for billing purposes and for mail processing purposes. This allows rapid and easy detection of errors in the processing of the mailpiece and, if appropriate, correction of such detected errors, as for example, scanning errors. Finally, at 316, the mailpiece is imprinted with the origination address, the destination address, the MID, the MSD, the PAB, DATE and the error detection correction codes. The process thereafter loops back and continues for the next mailpiece.

Figure 7:
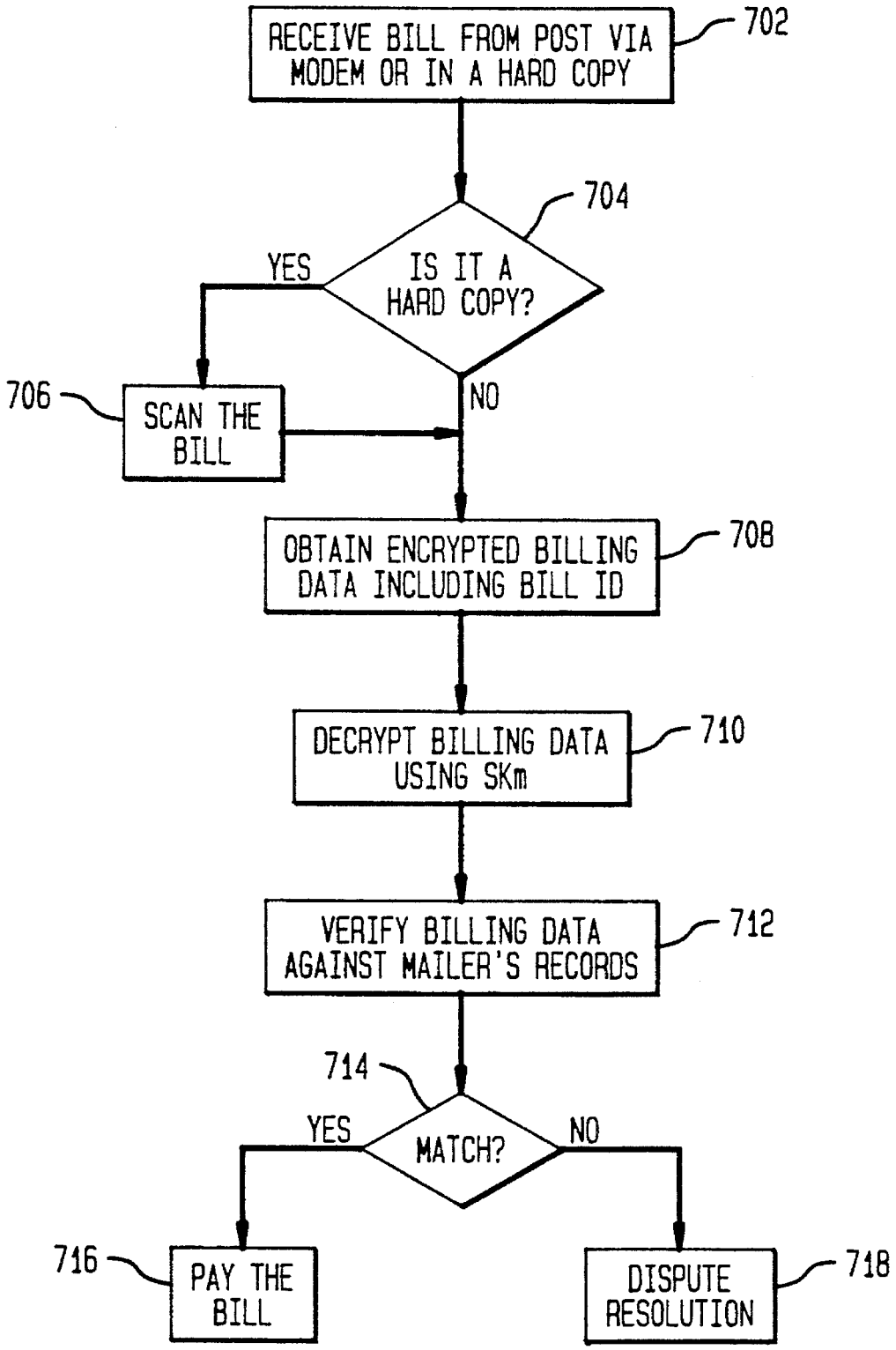
FIG. 7 is a flow chart of the operations performed by a mailer in processing a bill received from the carrier; and, FIG. 8 is a flow chart of the process by a carrier to provide enhanced services to the mailer.

Reference is now made to FIG. 7 which is a flow chart of the operations performed by the mailer in processing a bill received from the carrier. A bill is received from a carrier either in hard copy form or via a modem at 702. A determination is then made at 704 whether the bill is in hard copy form in which case the bill is scanned at 706. In either case, either by scanning or by processing, the encrypted billing data including the bill identification is obtained at 708. The encrypted information is decrypted by the mailer using the mailers private key $SK_M$ at 710. The billing data is thereafter verified against the mailers own records at 712. If a determination is made at 714 that the carriers bill data and the mailer's records match, the mailer may authorize payment of the bill at 716. If no match occurs, the matter is scheduled for resolution at 718. The payment by the mailer may be by electronic funds transfer.

III. Carder System

Figure 4:
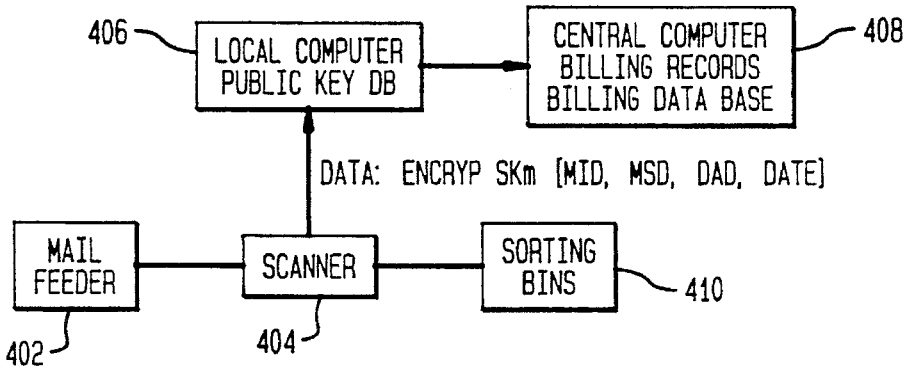
FIG. 4 is a block diagram of a carrier processing system for the generation of billing records.

Reference is now made to FIG. 4 which is a block diagram of a carrier processing system for generation of billing records. Mailpieces, such as mailpiece 100, are moved by a mail feeder 402 to a scanner 404 for scanning. The scanned document includes among other things the scanning of the various barcoded information imprinted on the mailpiece. The scanning of the MID provides the information which is sent to the local computer 406 to retrieve from a public key database the public key associate with the mailer of the mailpiece being scanned.

The public key so recovered is used to decrypt the encryption of the MID, MSD, DAD, and DATE data, using the mailers private key $SK_M$. This allows the computer to generate the necessary data for billing which may either be retained at the local computer 406 or communicated to a central billing computer 408 where billing records and billing database may be maintained. The mail passing the scanner is thereafter sent to sorting bins at 410 for further physical processing to allow expedited delivery of the mail and parcels.

Figure 5:
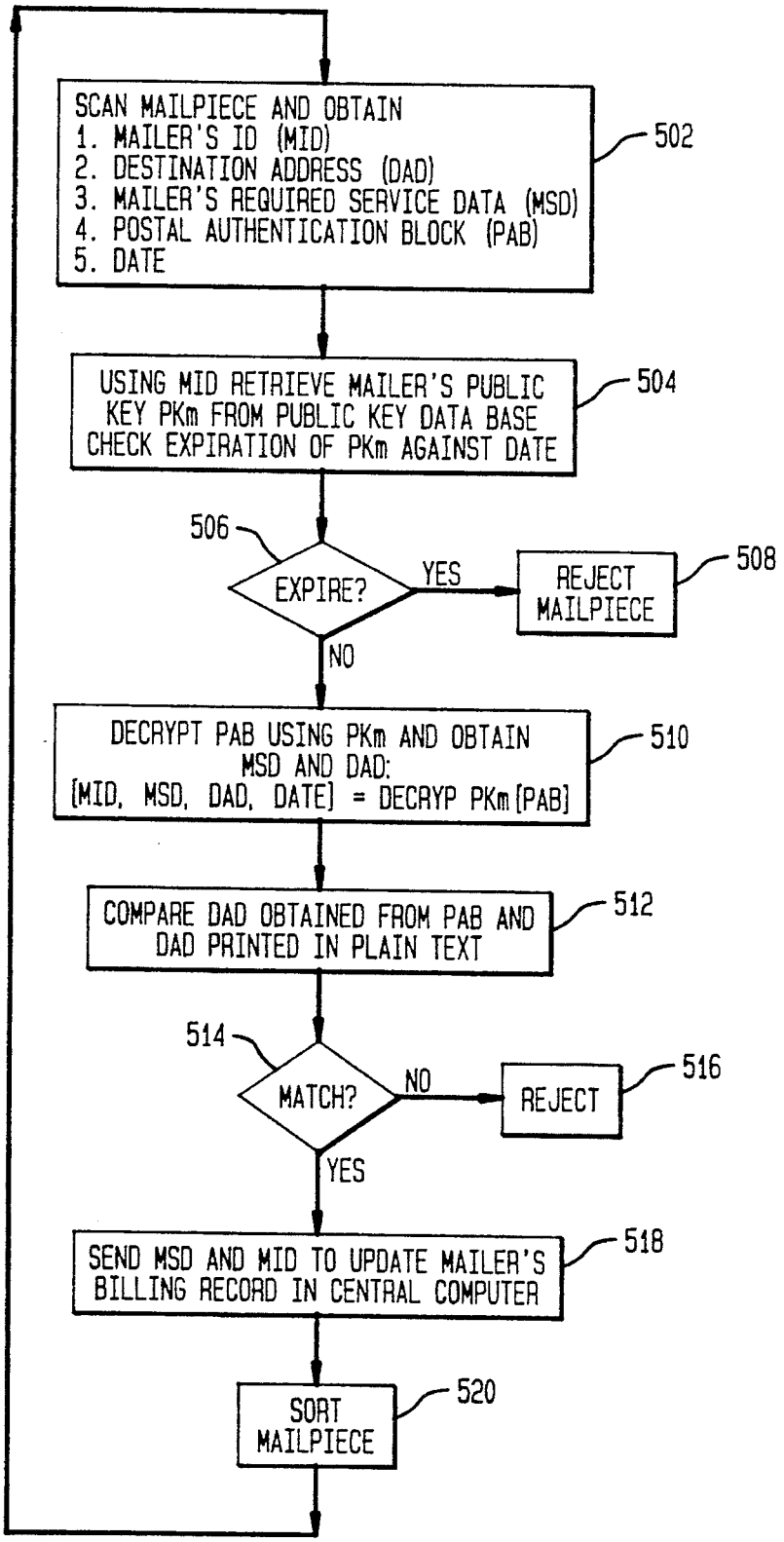
FIG. 5 is a flow chart of the operation of the carrier mail processing system shown in FIG. 4.

Reference is now made to FIG. 5 which delineates in greater detail the operation of the mail carrier processing system shown in FIG. 4. At 502 the mailpiece is scanned to obtain data from the mailpiece. This data includes mailers identification data (MID), destination address data (DAD), mailers required service data (MSD), postal authentication block (PAB) and DATE. Thereafter, using the mailers identification (MID), the mailers public key ($PK_M$) is retrieved from the public key database at 504. Additionally, if desired, a process may be implemented to check the expiration date of the public key $PK_M$ against the data of the imprinted mail. This is to insure that mailers are not using expired private keys to encrypt their mail and provides a level of security where mailers private encryption keys expire in a preset period of time. This insures that only mail from legitimate subscribers to the service is processed. Thus, an individual mailer which at one time was a legitimate subscriber who allowed the subscription to the service to expire, may be identified to allow processing or rejection of the mailpiece depending upon the policy and practice of the carrier. At decision block 506 a determination is made whether the time has expired such that the mailers key is no longer valid. If this is the case, the mailpiece is rejected at 508.

If the key of the mailer is still valid, the carrier then decrypts the postal authentication block (PAB) using the mailers public key $PK_M$ at 510. This enables the carrier to obtain the mailers required service data (MSD) and the destination address data (DAD). Additionally, as a result of the decryption the data blocks MID, MSD, DAD and DATE become available in plaintext for processing by the carrier. This data can be used to schedule the delivery of the mailpiece and in conjunction with the scheduling of the sorters such that mail requiring next day delivery is sorted differently than mailpieces requiring normal delivery and other special services such as certified mail, registered mail, insured mail, or other forms of express delivery mail are also appropriately sorted. The destination address data (DAD) is obtained from the decryption of the postal authentication block (PAD) is then compared with the destination address (DAD) printed in plaintext on the mailpiece at 512. If a match does not occur at decision block 514 the mailpiece is rejected at 516. If however, a match does occur, the mailers required service data MSD and mailer identification data MID is utilized to update the mailers billing records in the local computer or central computer as the case may be at 518. The mailpiece is thereafter is sorted at 520 for further processing. The processes thereafter loops back and continues for the next mailpiece.

Figure 6:
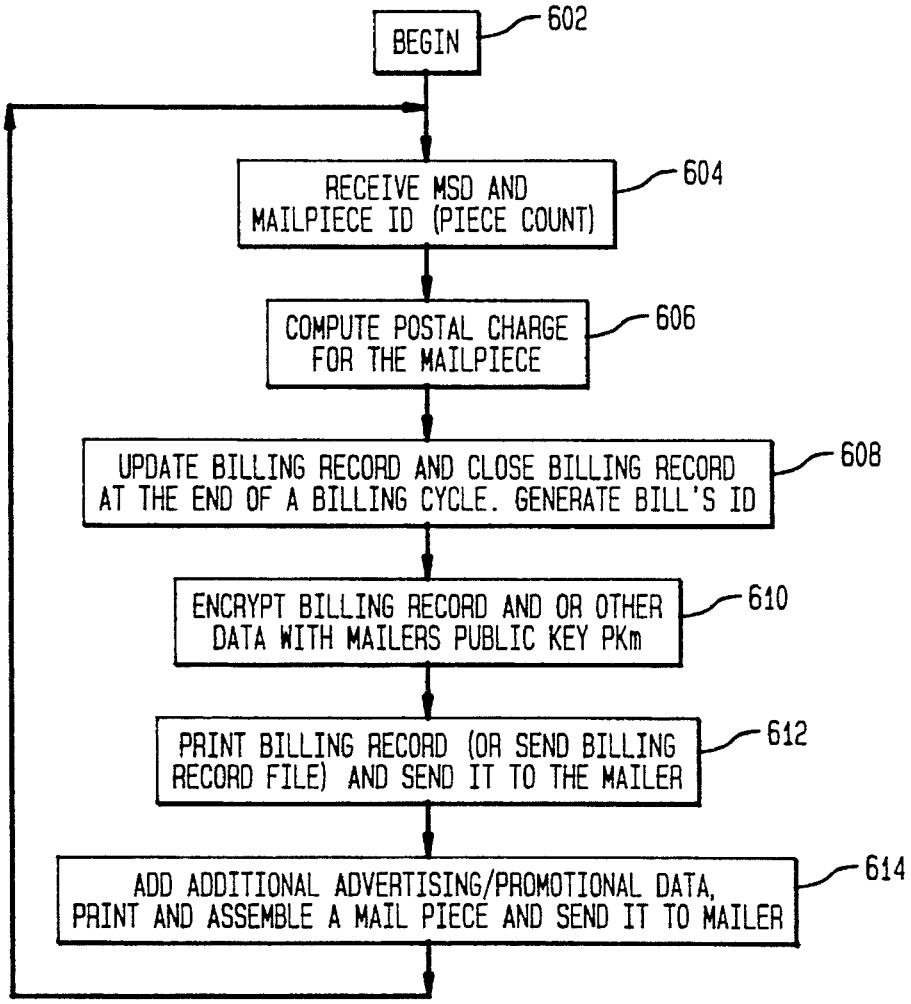
FIG. 6 is a flow chart of the bill generation process employed by a carrier.

Reference is now made to FIG. 6 which is a flow chart of the bill generation process employed by the carrier. The postal central computer updates and maintains billing records and also generate bills, as is a normal and well known process in billing traditional functions. In addition to traditional functions, however, this computer can provide for privacy of the billing data by encrypting this data with the mailer's public key PKm before printing it or sending such data via public telecommunication network. The format of the data can be agreed upon beforehand. In this case, the receiving party (the mailer) would be able to automatically interpret the data upon decrypting it with his or her private key SKm. This way the data is available only to the party in possession of the SKm, i.e. the mailer.

The process begins at 602 and loops for each mailpiece and each mailer identification. Thus, at 604 the mailers required service data (MSD) and mailpiece identification (piececount) are received for a particular mailer identification. The postal charges for the mailpiece are computed at 606. At 608 the billing record is updated for the mailer. The billing records are closed at the end of a billing cycle. This enables the carrier to generate a bill for the mailer. The process includes the generation of a bill identification. The billing record is thereafter encrypted at 610 with the mailer's public key $PK_M$.

Additional information of value to the mailer may also be encrypted or provided in a plaintext format at 610 such as additional services available, special discounts available as for example for mail delivered between certain dates or certain times or certain destinations. Also address hygiene information and other information of value to the mailer may be encrypted and provided to the mailer. This allows the carrier to process a mailer's bill and provide additional services to the mailer which are returned to the mailer with the mailers bill in encrypted format or non-encrypted format as mailer may desire. Thus, if the billing information is encrypted only the mailer who has possession of the mailer's private key $SK_M$ can decrypt and process the bill. The billing record is then printed at 612 and sent to the mailer. Alternatively, the bill can be an electronic billing file which is electronically communicated to the mailer for payment or automatic funds transfer from a mailers account.

At 614 additional information may be added to the mailers bill such as additional advertising and promotional data. This may be incorporated in the mailpiece in accordance with various topping-off arrangement, if desired, where there is available additional capacity in the mailpiece which would avoid going through a postage weight break. This enables unused (but charged for) space in the envelope to be utilized. The final mailpiece bill is assembled and sent to the mailer at 614 if this optional additional feature is utilized (rather than having the mailpiece bill sent to the mailer at 612. The information encrypted by the carrier with the mailer's public key $PK_M$ may be the billing date alone, the additional information (or part of it alone) or both the billing data and the additional information (or part of it).

Figure 8:
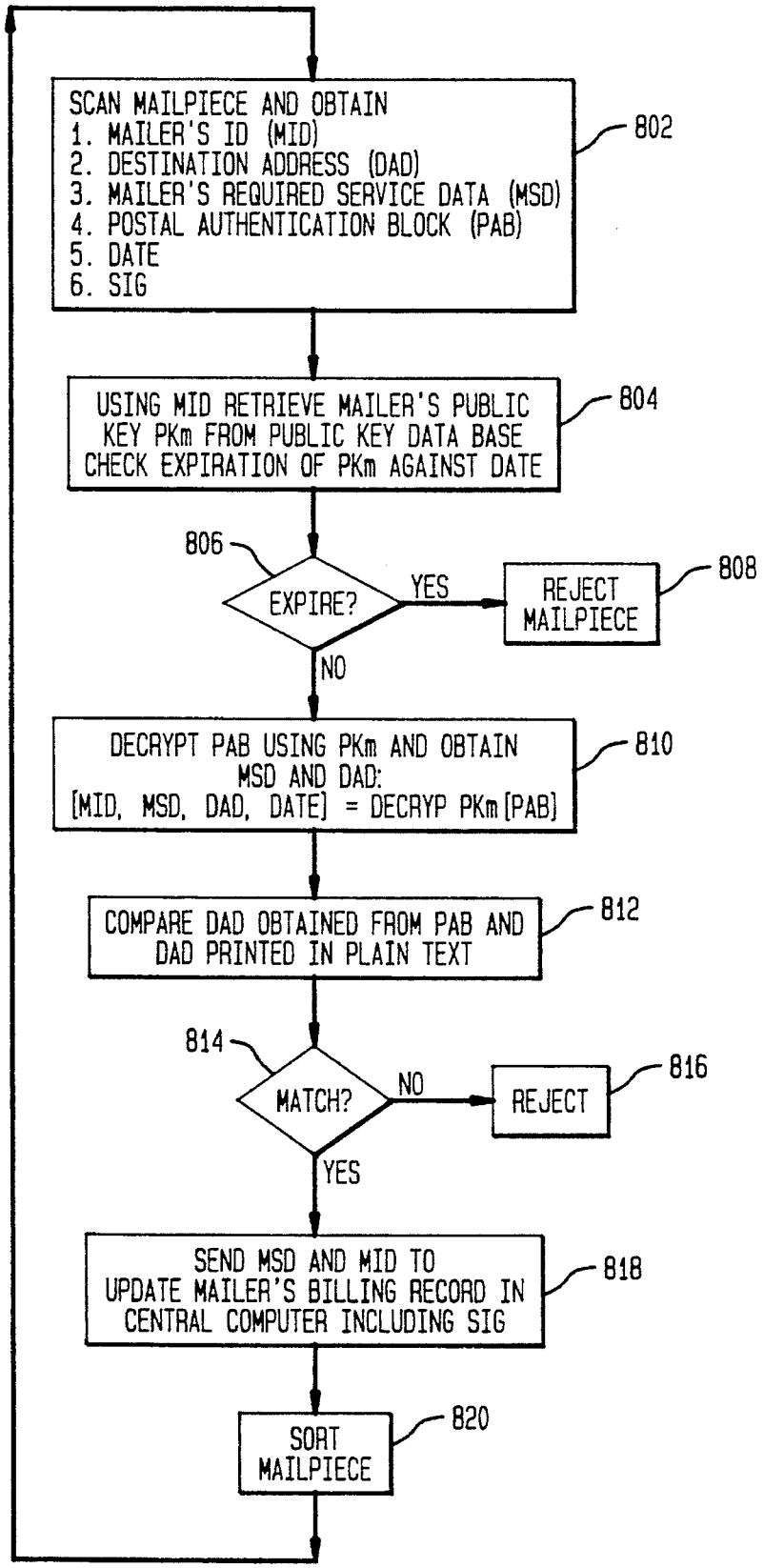

Reference is now made to FIG. 8 which is flowchart of the process by the carrier to provide enhanced services to the mailer. The mail recipient can effectively confirm the receipt of a mailpiece. For this purpose, mail recipient upon receiving a mailpiece with delivery confirmation obtains the sender (mailer's) MID and the unique mailpiece identification PC (Piece Count) from the received mailpiece. These two numbers uniquely identify the mailpiece. The receiving party then encrypts these two numbers with his own (recipient's) private key $SK_r$ and prints a receipt with a receiver authentication block RAB (which constitutes a digital receipt). RAB is as follows:

$$RAB = \{Encryp\ SKr[MID, PC, RDATE], RID, \},$$

where RID is the unique receiver identification number and RDATE is the date of receiving the mailpiece. The RID may be the same as the mailer identification data used by the receiver to process mail to be sent, i.e. when the receiver is an originating mailer.

The receipt can now be sent to the sender via regular or electronic communication, or it can be included with the mailer's bill. Upon receiving such receipt, the original mailer would have to create an electronic copy of RAB (if it arrives in a hard copy) by scanning the receipt, and then find the receiver's public key PKr in a postal public key directory using RID (receiver's identification). The encrypted portion of RAB is then decrypted to obtain MID and PC:

$$[MID, PC, RDATE] = Decryp\ PKr\{EncrypSKr[MID, PC, RDATE]\}.$$

MID and PC can now be compared with the mailer's records and the match would serve as a confirmation of receipt for the mailpiece.

Since only the receiver is in possession of SKr, he or she can not repudiate the fact of receiving of the mailpiece.

This process can be extended to authenticate the mailpiece content, and not only the fact of sending/receiving the mailpiece. The sender creates a hash value of the information printed in the letter (mailpiece) and encrypt this hash value with sender's private key (a process referred to as digital signature):

SIG–Encrypt SKm{Hash(LINFO)}, where LINFO is information contained in the letter. This information is represented by ASCII file or any other suitable computer format. Digital Signatures are known and described in detail, for example, in Contemporary Cryptology, ed. G. Simmons, IEEE Press, 1993.

The digital signature SIG can be printed either in the address block window, or in some other suitable place on the mailing envelope in such a manner that the carrier will be able to scan it and store it together with mailers identification ID, mailpiece identification ID and a unique identification of the destination address (such as delivery point postal code). The sender can ask the carrier (serving as a trusted third party) to produce evidence that the mailpiece with a given signature was in fact delivered on a given date. Of course, the receiver can always claim that the content of the letter he received mismatch the signature, but would have to produce the evidence to that effect, and, moreover, if the original letter contained a traditional signature and printed on an appropriate stationary etc., such a claim would be difficult to prove. The digital signature can also be included with the bill together with the digital receipt of delivery.

Another method to certify the content of mailpieces is possible with a hybrid mail. In this case the mailer sends (via telecommunication lines) to the carrier a digital representation of desired messages. The carrier then distributes messages also electronically via telecommunication lines to carrier offices with locations closest to desired final destinations. Messages are then printed in these local carrier offices and the physical mail is delivered by in the conventional fashion. In this arrangement, mailer can compute and transmit his or her digital signature together with each message and the carrier stores messages with signatures for further use if necessary. Alternatively, the carrier on behalf of the mailer can compute digital signatures for each message using its own private key and print them together with message prior to delivery. In either case, the carrier serves as a trusted third party providing non-repudiation service. In this instance the carrier scans multiple mailpieces of the mailer at 802 to obtain the mailers identification data (MID), destination address data (DAD), mailers required service data (MSD), postal authentication block (PAB), DATE and, finally, the mailers electronic signature (SIG). This signature SIG is the encryption using the mailers private key $SK_M$ of the hash function of the information contained in the letter (LINFO).

The process in this FIG. 8 is similar to the process in FIG. 5 with the addition of the signature information (SIG). The process continues as before and will not be described in great detail; however, at 804 the mailers public key is retrieved and the expiration date retrieved. A determination is made at 806 as to whether the mailer subscription to the carrier service has expired and, if so, the mailpiece is rejected at 808. If not expired, a decryption occurs at 810 using the mailers public key $PK_M$ to obtain the necessary data at 812. The destination address data obtained from the plaintext and from the decryption is compared at 814. If a match does not occur, the mailpiece is rejected at 816. If a match does occur, the MSD and MID is sent to update the mailers billing records at 818 and the mailpiece is sorted at 820.

What is claimed is:

1. A method for mail piece processing, comprising the steps of:

imprinting on a mail piece mailer information;

encrypting data relative to the mail piece with a private key associated with said mailer identification information, said private key having associated therewith a public key;

imprinting on said mail piece the said encrypted data;

placing said mail piece in a mail delivery stream of a mail piece carrier;

processing said mail piece to determine said mailer identification information, using said mailer identification information to obtain said public key;

decrypting the encrypted data with said public key to authenticate said mailer;

updating billing records for said mailer for charges associated with said mail piece; and encrypting billing record data for said mailer with said public key and transmitting said encrypted billing record data to said mailer.

2. A method for mail piece processing as defined in claim 1 wherein said encrypted billing record data is transmitted electronically to said mailer.

3. A method for mail piece processing as defined in claim 1 wherein said encrypted billing record data is transmitted in physical form to said mailer.

4. A method as defined in claim 1 wherein said encrypted billing record data include data for a plurality of mailpieces.

5. A method as defined in claim 1 wherein said mailer reconciles said encrypted billing record with mailer generated postage due record.

6. A method as defined in claim 1 wherein the step of encrypting said billing record further includes encrypting additional data with said mailer public key.

7. A method as defined in claim 6 wherein said additional data includes address hygiene data.

8. A method as defined in claim 6 including the further step of establishing a communication channel to said mailer by transmitting said encrypted billing record and said encrypted additional data to said mailer.

9. A method as defined in claim 8 wherein said additional data includes availability of lower rates for said mailer.

10. A method as defined in claim 8 wherein said additional data includes advertising information.

11. A method as defined in claim 8 wherein said additional data includes mailing lists and address hygiene data.

12. A method for generating an electronic receipt for a mailpiece, comprising the steps of:

receiving a mailpiece;

determining from said mailpiece mailer identification data and mailpiece identification data;

encrypting said determined mailer identification data and said determined mailpiece identification data and recipient identification data with a recipient private key;

said recipient private key having an associated public key; and transmitting to said mailer said encrypted data and the recipient identification data.

13. A method as defined in claim 12 wherein said encryption further includes other data associated with said mailpiece by said recipient.

14. A method as defined in claim 13 wherein said other data associated with said mailpiece includes the date of receipt of said mailpiece.

15. A method for authenticating receipt of specific information of a mailpiece, comprising the steps of:

generating a hash code for said specific information of a mailpiece;

encrypting said generated hash code for said mailpiece with a first private key to generate an encrypted hash code of said mailpiece information, said first private key having an associated first public key;

transmitting said mailpiece along and said encrypted hash code;

receiving said mailpiece and said encrypted hash code by a recipient; and, encrypting said encrypted hash code with a second private key to generate recipient encrypted information, said second private key associated with said recipient said second recipient private key having associated therewith a second public key.

16. A method as defined in claim 15 further including the steps of: transmitting said recipient encrypted information to said mailer.

17. A method for processing mail comprising the steps of:

generating a mailpiece;

generating a hash code based on the content of said mailpiece;

encrypting said hash code;

imprinting on said mailpiece addressee data; and, imprinting on said mailpiece said encrypted hash code.

18. A method as defined in claim 17 further including:

delivering said mailpiece to carrier;

said carrier retrieving said encrypted hash code and said addressee data; and, said carrier storing said retrieved encrypted hash code and addressee data.

19. A method as defined in claim 18 further including said carrier delivering said mailpiece to said addressee and storing said delivery date along with said retrieved encrypted hash code and addressee data.

20. A method as defined in claim 18 wherein said carrier generates said hash code of the content of said mailpiece.

21. A method as defined in claim 18 wherein said encrypted hash code and addressee data are retrieved by scanning said mailpiece.

* * * * *